US010094542B2

(12) United States Patent
Chauvet et al.

(10) Patent No.: US 10,094,542 B2
(45) Date of Patent: Oct. 9, 2018

(54) PORTABLE MULTI-FUNCTION LIGHTING SYSTEM

(71) Applicant: CHAUVET & SONS, LLC, Sunrise, FL (US)

(72) Inventors: Albert Chauvet, Plantation, FL (US); Allan Reiss, Coral Springs, FL (US); Nick Airriess, New Berlin, WI (US)

(73) Assignee: Chauvet & Sons, LLC, Sunrise, FL (US)

( * ) Notice: Subject to any disclaimer, the term of this patent is extended or adjusted under 35 U.S.C. 154(b) by 19 days.

(21) Appl. No.: 15/013,208

(22) Filed: Feb. 2, 2016

(65) Prior Publication Data

US 2016/0223173 A1 Aug. 4, 2016

Related U.S. Application Data

(60) Provisional application No. 62/110,736, filed on Feb. 2, 2015.

(51) Int. Cl.
*F21V 21/06* (2006.01)
*F21V 21/116* (2006.01)
(Continued)

(52) U.S. Cl.
CPC ..... *F21V 21/116* (2013.01); *F21L 2/00* (2013.01); *F21V 23/003* (2013.01)

(58) Field of Classification Search
CPC ..... F21L 2/00; F21V 21/116; F21V 21/14; F21V 23/003; F21V 21/145; F21V 21/15; F21V 21/22; F21V 21/06
See application file for complete search history.

(56) References Cited

U.S. PATENT DOCUMENTS 4,167,783 A 9/1979 Mitchell
5,964,524 A 10/1999 Qian
(Continued)

FOREIGN PATENT DOCUMENTS

CA 2256810 A1 7/1999
JP S6212616 U 1/1987
(Continued)

*Primary Examiner* — Peggy Neils
(74) *Attorney, Agent, or Firm* — Laurence A. Greenberg; Werner H. Stemer; Ralph E. Locher

(57) ABSTRACT

A portable, multi-function lighting apparatus is provided that is easy to transport, re-configure and use. The lighting apparatus is configured to readily remove and replace light fixtures, so that a user can vary and customize the lighting effects as desired for each event and the apparatus can be easily disassembled and packed for transport and storage. Optionally, the apparatus can be provided as part of a kit including a light bar removably mounted on a stand, and a bag into which the light bar and stand can be stored and transported. Such a kit can also be provided with a foot-switch for activating features powered by, and mounted to, the light bar. Lighting modules and/or other devices can be added to and removed from the light bar, as desired. Modules attached to the light bar receive power and control data from the light bar. Additionally, the portable, multi-function lighting apparatus can be connected with one or more other portable, multi-function lighting apparatus in a master slave relationship.

20 Claims, 5 Drawing Sheets

(51) Int. Cl.
*F21V 23/00* (2015.01)
*F21L 2/00* (2006.01)

(56) References Cited

U.S. PATENT DOCUMENTS

| | | | | |
|---|---|---|---|---|
| 7,784,980 | B2 * | 8/2010 | Tsao | A01M 29/10 116/22 A |
| 7,810,964 | B2 * | 10/2010 | Probasco | F21S 8/028 362/154 |
| 8,035,320 | B2 * | 10/2011 | Sibert | H05B 37/0245 315/149 |
| 8,087,797 | B2 | 1/2012 | Pelletier et al. | |
| 8,714,789 | B2 * | 5/2014 | Moore | F21V 21/22 362/227 |
| 9,185,776 | B2 | 11/2015 | Ahem | |
| 9,262,948 | B2 * | 2/2016 | Pounders | G09F 15/0018 |
| 9,316,384 | B2 * | 4/2016 | Mumma | F21L 14/00 |
| 9,574,725 | B2 * | 2/2017 | Pellenc | H05B 33/0842 |
| 2013/0265780 | A1 * | 10/2013 | Choksi | F21V 21/145 362/373 |
| 2013/0322073 | A1 * | 12/2013 | Hamm | F21V 21/06 362/235 |
| 2016/0286629 | A1 * | 9/2016 | Chen | H05B 37/0272 |

FOREIGN PATENT DOCUMENTS

| | | | |
|---|---|---|---|
| JP | 3074481 | U | 1/2001 |
| WO | 2014043551 | A1 | 3/2014 |

* cited by examiner

Fig. 5
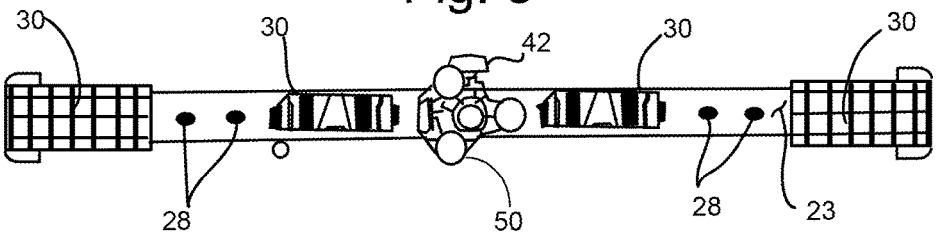
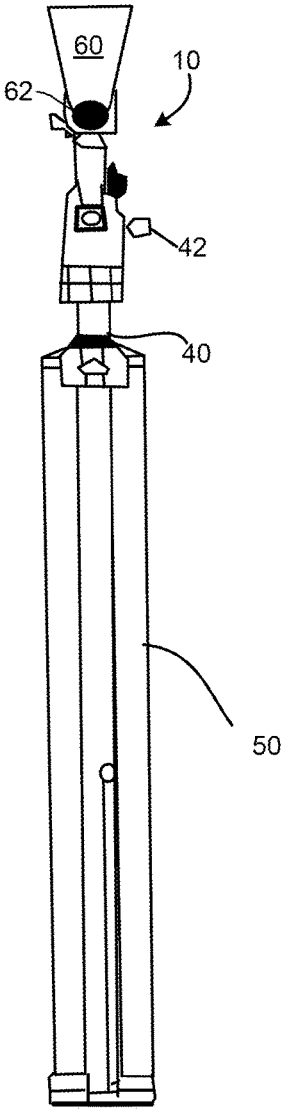
Fig. 2

PORTABLE MULTI-FUNCTION LIGHTING SYSTEM

CROSS-REFERENCE TO RELATED APPLICATIONS

The present application claims benefit of Provisional Patent Application No. 62/110,736, filed on Feb. 2, 2015; that application being incorporated herein, by reference, in its entirety.

BACKGROUND OF THE INVENTION

Field of the Invention

The present invention relates to lighting equipment and, more particularly, to a portable lighting apparatus configurable with multiple light fixtures and/or other accessory devices.

Description of the Related Art

The use of lighting effects for events and applications has increased greatly over recent years. Today, it is common for lighting effects to be used at concerts, shows, clubs, trade shows, corporate events, weddings and other parties and events. Lighting effects have become part of the overall experience for many events and production companies and event planners often select venues based on the lighting effects offered.

Lighting fixtures and other equipment used to produce the lighting effects are often permanently installed in stadiums, arenas, theaters, clubs and other venues that regularly host events that require lighting effects. Portable equipment is also available for use by production, entertainment and event companies, Disc Jockeys (DJs) and venues to produce lighting effects for weddings and other parties, corporate events, trade shows and other events at remote locations and at venues that do not have lighting installations capable of producing the lighting effects desired for the particular event.

However, the portable lighting equipment available for events at remote locations and venues not having the desired lighting equipment is generally limited due to the difficulties and costs associated with transporting many different types of lights to the event and the difficulties and extensive time and space required to set-up, program and operate numerous lights and to then breakdown, pack and transport the equipment once the event is over. As a result, the desired lighting effects may not be available at events at remote locations and venues not having installed lighting equipment. Consequently, event planners may select alternative locations or settle for less than the desired lighting effects.

Systems and methods for providing visual effects are known in the art. For example, PCT patent application No. WO 2014/043551 A1 to Woods et al., discloses a compact modular visual effects device including a housing having a plurality of receptacles each adapted to receive and to provide at least a supply of power and a control signal via a control signal input to an interchangeable visual effects device. U.S. Pat. No. 4,167,783 to Mitchell discloses a portable lighting system that includes a stand having an adjustable effective length which positions lights carried on a frame and having a foot operated dimmer. U.S. Pat. No. 8,087,797 to Pelletier discloses an illumination device with detachable light sources. U.S. Pat. No. 9,185,776 to Ahern discloses a user-actuated lighting effect device including a housing, a light-generating lamp coupled to the housing a power source and a control circuit.

However, there is a need in the art for a new and improved portable, multi-function lighting apparatus that includes multiple lighting effects, which is stand mounted, easily transported and reconfigured and which can be coupled to other like lighting apparatus' in a master-slave arrangement. More particularly, such apparatus should be capable of use with different types of lighting fixtures. Such apparatus should also include the ability to readily remove and replace light fixtures, so that the user can vary and customize the lighting effects as desired for each event and the apparatus can be easily disassembled and packed for transport and storage. Such apparatus should additionally be capable of being operated and controlled locally by controls on the apparatus, by a wireless remote or remotely by digital multiplexing (DMX512 or DMX), ACN, ArtNet, KlingNet, Dali or any other data control protocol now known or later developed. Such apparatus should also be capable of being combined with other equipment or used in a modular manner in combination with one or more additional units of the present invention to create a larger entertainment system. Such apparatus should be further capable of being mounted to trusses and other fixed and portable structures.

BRIEF SUMMARY OF THE INVENTION

The present invention is particularly suited to overcome those problems which remain in the art in a manner not previously known or contemplated. It is accordingly an object of the invention to provide a portable lighting apparatus that is easy to transport, re-configure and use. In one particular embodiment of the invention, a lighting apparatus is provided that can be used with different types of lighting fixtures. The lighting apparatus is configured to readily remove and replace light fixtures, so that a user can vary and customize the lighting effects as desired for each event and the apparatus can be easily disassembled and packed for transport and storage. For example, in one particular embodiment, a kit is provided including a portable lighting apparatus including a light bar removably mounted on a stand, and a bag into which the light bar and stand can be stored and transported. In another embodiment, the kit includes a footswitch for activating features powered by, and mounted to, the light bar. In a further embodiment of the invention, a portable, multi-function lighting apparatus is provided that is configured to be connected with one or more other portable, multi-function lighting apparatus in a master slave relationship.

Although the invention is illustrated and described herein as embodied in a portable multi-function lighting system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The foregoing background, as well as the following detailed description of the preferred embodiments, is better understood when read in conjunction with the appended drawings. For the purpose of illustrating the invention, there is shown in the drawings an exemplary embodiment that is presently preferred, it being understood however, that the invention is not limited to the specific methods and instrumentality's disclosed. Additionally, like reference numerals represent like items throughout the drawings. In the drawings:

FIG. 2 is a side plan view of the portable, multi-function lighting apparatus of FIG. 1;

FIG. 5 is a bottom plan view of a mounting bar of a portable, multi-function lighting apparatus, in accordance with one particular embodiment of the invention;

DETAILED DESCRIPTION OF THE INVENTION

Figure 1:
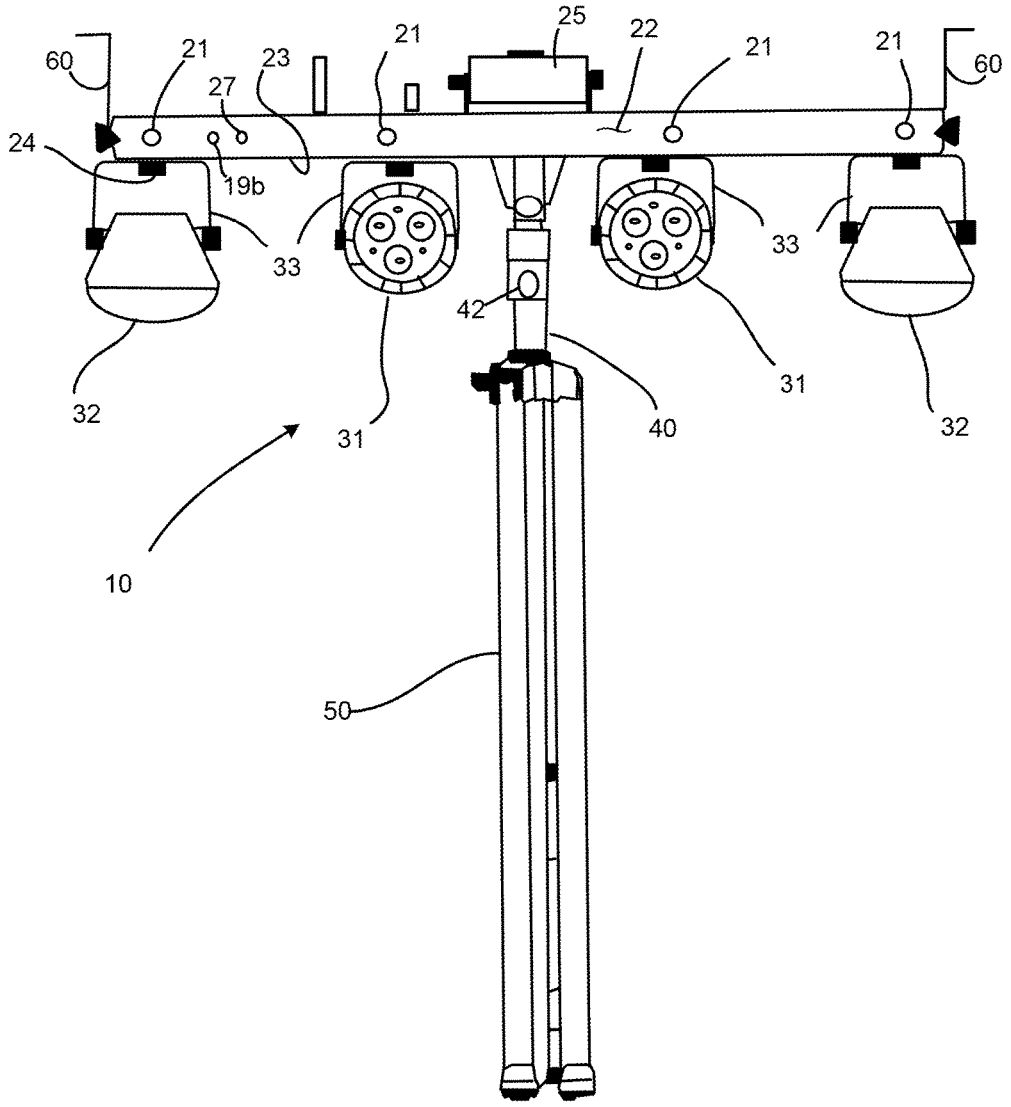
FIG. 1 is a front plan view of the portable, multi-function lighting apparatus, in accordance with one particular embodiment of the invention.
Figure 3:
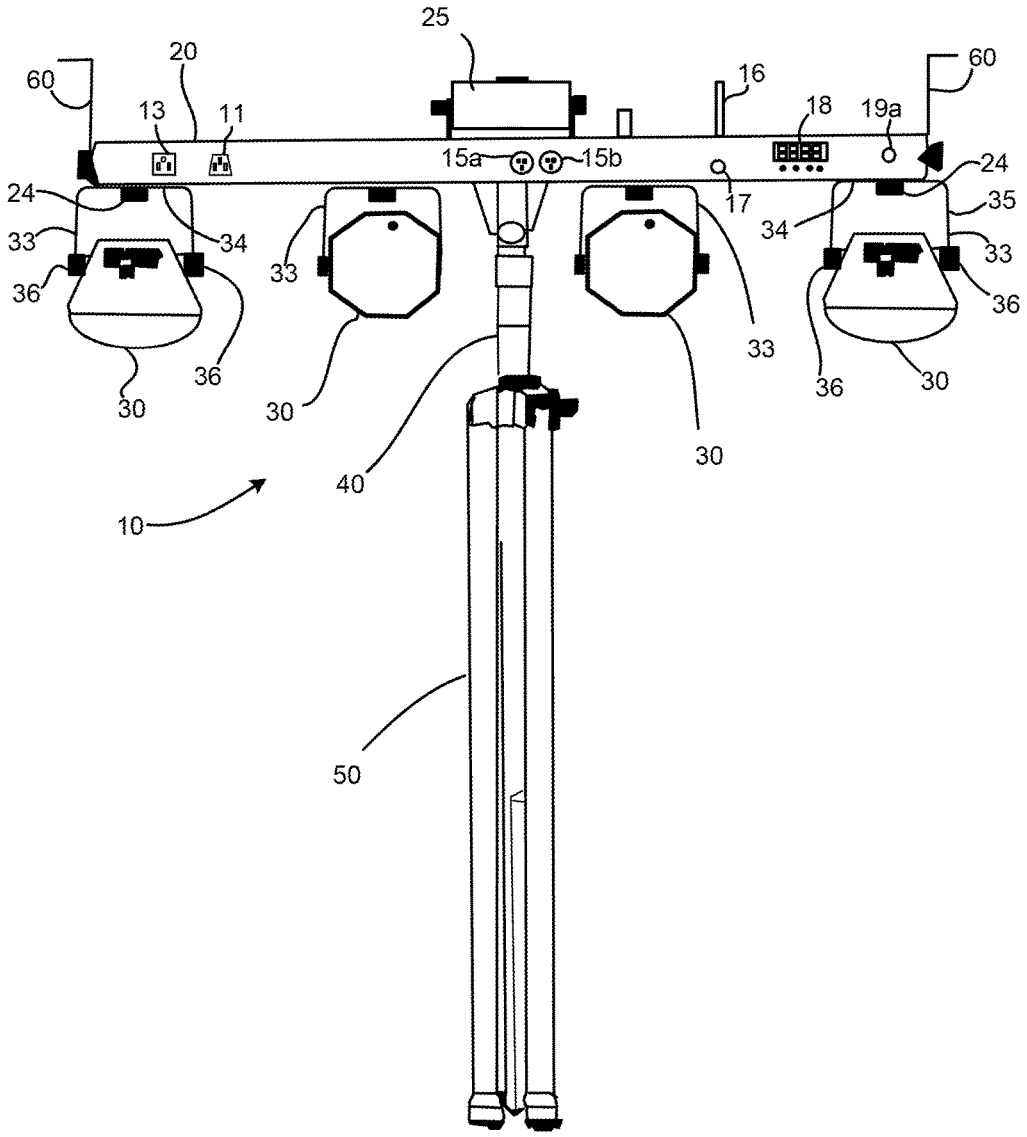
FIG. 3 is a rear plan view of the portable, multi-function lighting apparatus of FIG. 1.
Figure 6:
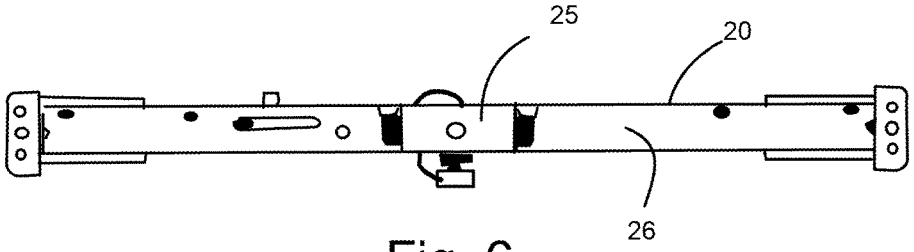
FIG. 6 is a top plan view of the mounting bar of FIG. 5.
Figure 4:
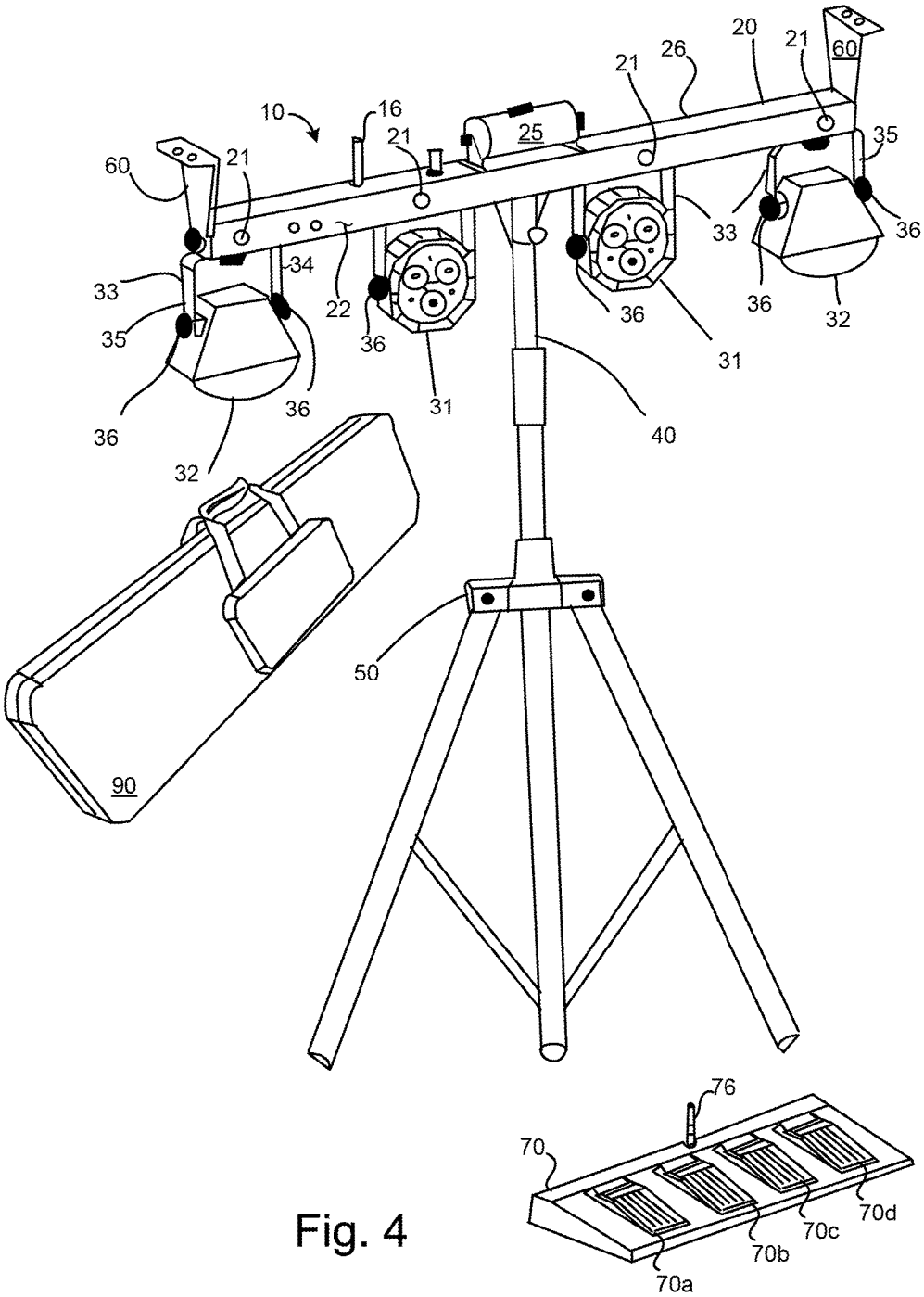
FIG. 4 is a top perspective view of a portable, multi-function lighting apparatus kit in accordance with one particular embodiment of the invention.
Figure 7:
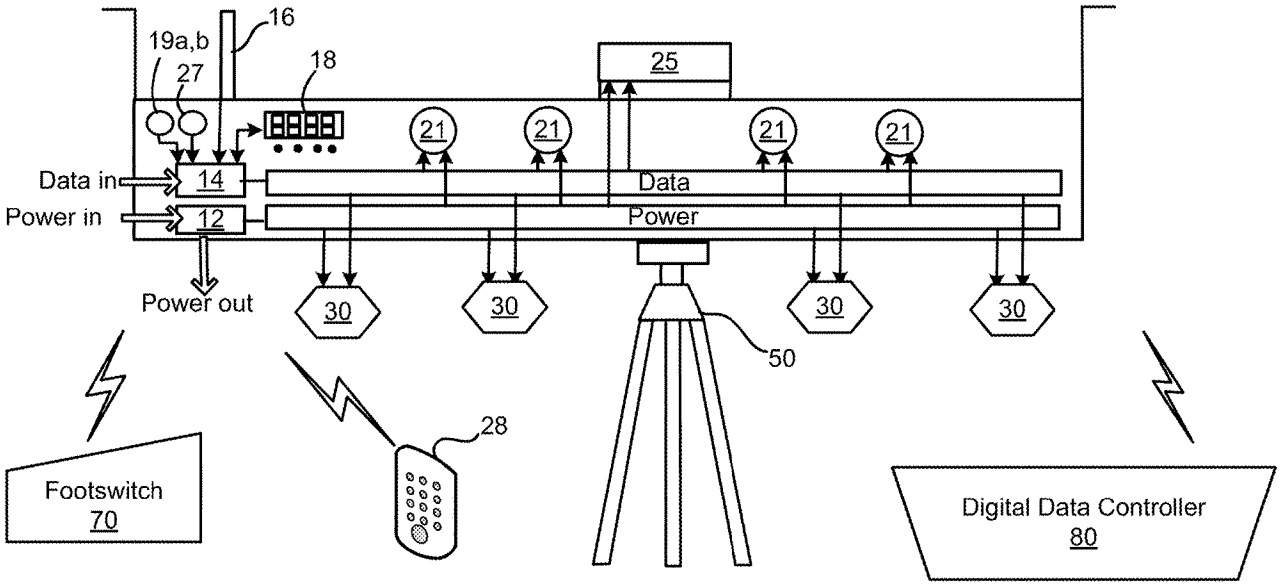
FIG. 7 is a simplified block diagram of a device in accordance with one particular embodiment of the invention.

Before explaining the disclosed embodiment of the present invention in detail, it is to be understood that the invention is not limited in its application only to the details of the particular arrangement shown since the invention is capable of other embodiments. Also, the terminology used herein is for the purpose of description and not of limitation.

Referring now to FIGS. 1-8, the present invention is directed towards a new and improved portable, multi-function lighting apparatus 10. Advantageously, the lighting apparatus 10 is reconfigurable, in situ, as desired by the user. In particular, the portable, multi-function lighting apparatus 10 is built around a mounting bar or mounting light bar 20, to which a plurality of lighting fixtures 30 and/or other types of modules and accessories can be mounted. In the most preferred embodiment, the mounting bar 20 is configured to provide power and data to the fixtures 30 mounted thereto. In other words, the mounting bar 20 acts as a power and data bus for the attached fixtures 30 and other electrical devices.

More particularly, in one particular embodiment of the invention, the portable, multi-function lighting system or apparatus 10 includes the mounting light bar 20, a plurality of light fixtures 30, a telescoping pole 40 and a tripod 50. In a preferred embodiment, the mounting light bar 20 is generally rectangular shaped with a generally square cross section and a hollow interior cavity. The mounting light bar 20 includes at least one light 21 mounted in the hollow interior cavity of the light bar 20 and oriented to project light outward from a hole in the front face 22. In one preferred embodiment, four strobe lights 21 are mounted in the light bar 20 and oriented to project light from four corresponding holes in the front face 22 of the bar. Thus, the four strobe lights 21 are structured to project a strobe light effect outward from the front face 22. It should be appreciated, however, that this is not meant to be limiting, as more or fewer lights 21 can be mounted in the bar 20, and other types of lights 21 and/or other lighting effects, such as ultraviolet lights, can be provided without departing from the scope and spirit of the present invention.

The mounting light bar 20 additionally includes a plurality of threaded mounting holes, which in the present preferred embodiment are threaded, in its bottom face 23 for securing the light fixtures 30 to the mounting bar 20. In a preferred embodiment shown in FIG. 5, four light fixtures 30 are shown, but it should be appreciated that the number of light fixtures may vary within the spirit and scope of the present invention. The light fixtures 30 are removably secured to the bottom face 23 of the mounting light bar 20 by threaded knob screws 24, but may be removably secured by any other means now known or later developed. For example, the fixtures 30 may snap into holes in the face 23, or may slide to discrete locations in a track formed in the bottom of the bar 20, or, in another embodiment, may be physically and electrically connected to the bar 20 using a bayonet connector or other such mechanism.

In the present particular embodiment, each light fixture 30 includes a mounting bracket 33 with a mounting hole in the top portion 34, which is configured to be removably secured to the mounting light bar 20 by a threaded knob screw 24. Similarly, each light fixture 30 is removably secured between the side arms 35 of the mounting brackets 33 of by threaded screws 36, which are also, preferably, threaded knob screws. Threaded screws 36 are also used to adjust the illuminating angle and direction of each light fixture 30. Although threaded knob screws 36 are used to removably secure the mounting brackets to the mounting light bar 20 and to the light fixtures 30 and to adjust the illuminating direction of each light fixture 30 in the presently described preferred embodiment, the invention is not meant to be limited only thereto, as any other means now known or later developed may alternatively be used in connection with the mounting brackets 33 without departing from the scope or spirit of the present invention. Configured as shown, each of the fixtures 30 is individually adjustable relative to the bar 20, such that the user may direct the light from each fixture 30 in the same or different directions.

In one particularly preferred embodiment, the four light fixtures 30 comprise a pair of tri-color LED wash light fixtures 31 and a pair of LED derby light fixtures 32. However, it should be appreciated that more or less than four light fixtures 30, other types of light fixtures 30 in place of the wash and derby light fixtures, including moving light fixtures, different quantities of each type of light fixture 30 and different order and placement of the light fixtures 30 on the mounting light bar 20 may be used without departing from the spirit and scope of the present invention. Additionally, in one particular embodiment, the apparatus 10 can be reconfigured by the user, in situ. For example, the positions of the fixtures 30 on the bar 20 can be swapped around, or the fixtures 30 themselves can be removed and/or replaced with other types of light fixtures or other types of non-light fixture modular accessory devices.

In one particular embodiment, in addition to the lights 20 and places for mounting the fixtures 30, the mounting light bar 20 also includes a laser light device or laser 25 secured to its top face 26. In a preferred embodiment, the laser 25 includes a red laser diode and a green laser diode and is structured and disposed to project multi-color laser light beams with a coverage angle of approximately 90 degrees from the same side of the apparatus 10 as the light projected from the strobe lights 21. It should be appreciated, however, that the position of the laser 25 on the mounting light bar 20, the number of light beams projected from the laser 25, the colors of the projected laser light beams and the direction and coverage angle of the projected laser light beams may vary within the spirit and scope of the invention. One or more additional lasers or light fixtures may be removably secured to the top face 26 of the mounting light bar 20 on either side of the laser 25. Alternatively, a light fixture may be used in place of the laser 25 on the top face 26 of the mounting light bar 20. Although the preferred embodiment discloses the light fixtures mounted to the bottom face 23 of the mounting light bar 20 and the laser to the top face 26 of the mounting light bar 20, it should be appreciated that the light fixtures could be mounted to the top face 26 of the mounting light bar 20 and the laser to the bottom face 23 of the mounting light bar 20. If desired, the mounting light bar 20 can additionally include mounting holes on the top face 26 of the mounting light bar 20, which are configured to receive additional fixtures 30. For example, in addition to holes and connection ports 28 accessible from the bottom face 23 of the mounting light bar, further holes and connection ports 28 could be included on the top face 26, on each side of the laser 25. In this way, further fixtures 30 can be mounted to the bar 20 and configured for programmed operation.

A mounting bracket 60 is removably secured to each end of the mounting light bar 20 by a threaded knob screw 62. The mounting bracket 60 may be used to secure the mounting light bar 20 to truss equipment, such as the TRUSST system marketed and sold by Chauvet® Lighting, and other fixed and portable structures. When mounted to truss and other structures, the mounting light bar 20 may be removed from the telescoping pole 40 and tripod 50, leaving only the mounting light bar 20 with the lights 21 secured in the bar 20 in alignment with the holes in the front face 22 and the attached light fixtures 30 and laser 25.

One end of the telescoping pole 40 is removably secured to the bottom face 23 of the mounting light bar 20 and the opposite end is slidingly secured to the tripod 50 by a threaded knob screw 42. The telescoping pole 40 is a conventional telescoping pole that may be extended or retracted for use, transport or storage as desired. The tripod 50 is a conventional three legged tripod structured to have its legs moved from a substantially vertical position where the legs are together, to a spaced apart position where the legs can support the mounting light bar 20 and its attached lighting equipment in a stable manner. Although a telescoping pole 40 and tripod 50 are disclosed in the preferred embodiment, it should be appreciated that the mounting light bar 20 may be removably secured to any other stand, including a non-telescoping or non-folding stand, or structure now known or later developed within the spirit and scope of the invention.

A power supply 12 and controller 14 are contained within the hollow interior cavity of the mounting light bar 20. The power supply 12 is structured to provide power to the light fixtures 30, the lights 21 secured within the bar 20 in alignment with holes in the front face 22 of the mounting light bar 20 and the laser 25. The controller 14 is structured to run the software programs that control the operation of the light fixtures 30, the lights 21 and the laser 25. Each preprogrammed software program stored in memory of the controller 14, and executed by the controller 14, is structured to operate the lights 21, fixtures 30 and/or laser 25 in a predetermined sequence.

Connection ports 28 are provided on the bottom face 23 of the mounting light bar 20 to electrically connect the light fixtures 30 to the power supply and controller within the mounting light bar 20, via a cable or cables from the fixtures 30. The connection ports 28 are electrically connected to the power supply and controller by cables or a bus within the mounting light bar 20.

Electrical outlets 11, 13 (for power in and power out, respectively) and additional connection ports (such as, DMX input interface or port 15*a* and DMX output interface or port 15*b*) may be provided on the rear face of the mounting light bar 20 to allow for other electrical equipment, such as a DJ's laptop or other equipment, to be powered from, and provide control data to, the mounting light bar 20. This capability provides the flexibility to combine the multi-function lighting apparatus 10 with other equipment to provide an expanded portable entertainment system for the event.

The portable, multi-function lighting apparatus 10 may be controlled at the unit by manually selecting and activating one of the automated programs stored within the controller 14 using the control panel buttons located beneath the LCD display 18, which provides information to the user regarding control panel operation and device operating modes. Additionally, in one particular embodiment of the invention, one of the pre-stored, automated programs within the controller 14 may be sound activated using the microphone 27. Alternatively, one of the automated programs stored within the controller 14 may be activated remotely by the user from a footswitch 70, which may be connected to the controller 14 via a wired or, more preferably, a wireless connection. In one particular embodiment, the footswitch 70 wirelessly communicates with the controller 14 by infrared signals received by one of the front or rear IR sensors 19A, 19B of the apparatus 10. In another embodiment, the footswitch 70 communicates with the controller via the antennae 16, 76. However, this is not meant to be limiting, as the footswitch 70 can communicate with the controller by any other communication means now known or later developed. Additionally, more than one footswitch 70*a*-70*d* may be provided for controlling more than one function, light or fixture of the apparatus 10.

A remote control 28 can additionally be provided to interact with the controller 14 and actuate different effects from the light bar 20. In one particular embodiment of the invention, the remote control 28 is an infrared remote control that beams signals via a line-of-sight connection to one of the IR sensors 19A, 19B.

The portable, multi-function lighting apparatus 10 may alternatively be controlled remotely from a digital data controller 80. In one preferred embodiment, the digital data controller is a digital multiplexing protocol (DMX) controller. DMX is a standard protocol for digital communication commonly used to control stage lighting and theatrical effects, including, but not limited to, moving lights, color changing lights and fog machines, and for color changing LED applications. Although a DMX controller is described in a preferred embodiment, it should be appreciated that any other control protocol now known or later developed may be used to control the portable, multi-function lighting apparatus 10 of the present invention. For example, the portable, multi-function lighting apparatus 10 may be controlled by a digital data controller providing digital data control signals in accordance with a data control protocol, such as, but not limited to, digital multiplexing (DMX512 or DMX), ACN, ArtNet, KlingNet, Dali or other known or later developed data control protocols. The digital data controller 80 can be connected to the controller 14 via a wired or, more preferably, a wireless connection. A wireless antenna 16 can additionally be provided to facilitate wireless communication to the apparatus 10.

Although the embodiment described above includes only light fixtures 30 and a laser 25 removably mounted to the mounting light bar 20, it should be appreciated that any type of equipment capable of providing theatrical or special effects, such as speakers, atmospheric machines, confetti launching machines and pyrotechnic equipment may additionally and/or alternatively be used in place of, or in addition to, the fixtures 30 and/or laser 25, without departing from the spirit and scope of the present invention.

Figure 8:
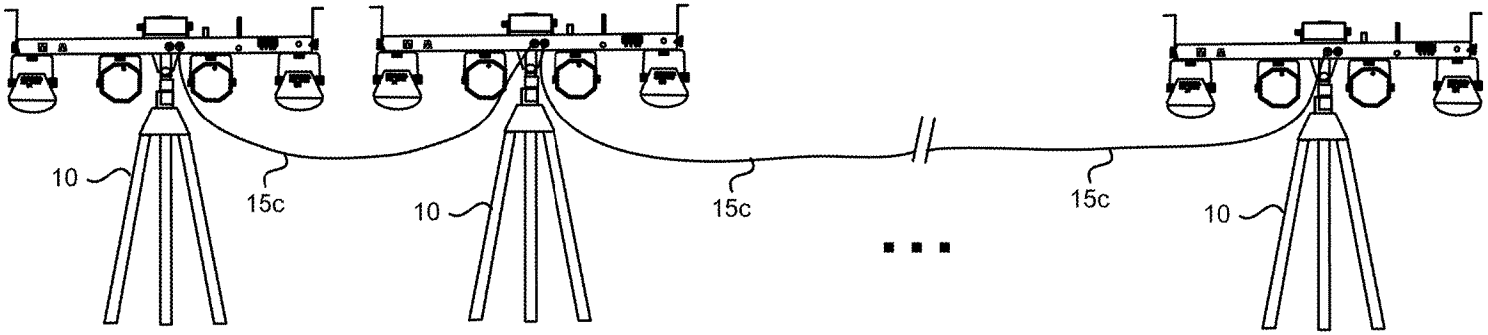
FIG. 8 is a simplified diagram of a plurality of portable, multi-function lighting apparatus' connected in a master-slave configuration in accordance with one particular embodiment of the present invention.

Referring now to FIG. 8, the portable, multi-function lighting apparatus 10 may be used in a modular manner in combination with one or more additional multi-function lighting apparatus 10 of the present invention, and/or other types of lighting apparatuses, to create a larger entertainment system. More particularly, a plurality of apparatus' 10 can be ganged or daisy-chained together by connecting the digital output (DMX output 15*b*) of the first apparatus 10 to the digital input (DMX input 15*a*) of the next apparatus 10 using an appropriate cable 15*c*, and so on until all units are connected. Alternately, they may be daisy-chained using wireless control protocols, such as wireless DMX. Chains of lighting apparatus' 10 can be formed in this way. When combined with additional multi-function lighting apparatus 10, the units will operate in a master-slave manner with the master multi-function lighting apparatus 10 controlling the operations of the other multi-function lighting apparatus 10. In this master-slave system, all of the linked multi-function lighting apparatus 10 can be controlled directly from the master multi-function lighting apparatus 10 or from the wireless footswitch 70 or DMX controller 80 in communication with the master multi-function lighting apparatus 10. In other words, the master unit 10 will generate and/or receive control signals which will be passed, serially, to each of the slave units 10.

In one particular embodiment of the invention, up to 31 slave devices 10 can be connected to a single master device 10. For example, signals actuating features on the master will be used to actuate the respective features on the master and will additionally be passed from slave to slave to serially actuate the same features on the slave devices, where applicable. The master/slave mode of operation allows a single apparatus 10 (the master) to control the actions of one or more apparatus 10 (the slaves) without the need to connect the slaves to a digital controller 80, or to otherwise provide control and synchronization capabilities within each slave. The master apparatus can be set to operate in either an automatic or sound-active mode, while the slaves are set by the control buttons to operate in slave mode. Once set and connected, the slave units will operate in unison with the master.

When not in use, the light fixtures 30 may be removed from the mounting light bar 20, the mounting light bar 20 may be removed from the telescoping pole 40, the telescoping pole 40 may be fully retracted and the tripod 50 may be moved into its compact position, so that all components of the portable, multi-function lighting apparatus 10 may be placed into a storage bag 90 or container for easy transport and storage. The portable, multi-function lighting apparatus 10 may then be easily transported and reassembled at the next location for use. If desired, the portable, multi-function lighting apparatus could be sold as a kit including one or more of a storage/carry bag 90 and/or a footswitch 70.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended. Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

We claim:

1. A portable, multi-function lighting apparatus including multiple different lighting effects, comprising:

a mounting light bar extending longitudinally and having an internal cavity and at least one opening formed in an outer surface of a longitudinally extending face of the mounting light bar;

at least one light source providing a first lighting effect mounted within the internal cavity in alignment with said at least one opening through the longitudinally extending face, wherein each at least one light source emits light through said at least one opening in accordance with the first lighting effect;

at least one light fixture removably secured to the mounting light bar outside said internal cavity and providing a second lighting effect different from the first lighting effect;

at least a second light fixture removably secured to the mounting light bar outside said internal cavity and providing a third lighting effect different from the first and second lighting effects;

a power source mounted within the internal cavity providing power to at least one of said at least one light source, said at least one light fixture or said at least a second light fixture.

2. The portable, multi-function lighting apparatus of claim 1, further comprising a controller mounted inside said internal cavity and providing control signals to at least one of said at least one light source, said at least one light fixture or said at least a second light fixture.

3. The portable, multi-function lighting apparatus of claim 2, further comprising a stand removably attached to said mounting light bar.

4. The portable, multi-function lighting apparatus of claim 3, wherein said stand is extendable and retractable.

5. The portable, multi-function lighting apparatus of claim 4, wherein the stand includes a folding tripod.

6. The portable, multi-function lighting apparatus of claim 1, further comprising a laser mounted to said light bar, said laser providing a fourth lighting effect different from said first, second and third lighting effects.

7. The portable, multi-function lighting apparatus of claim 2, wherein said controller includes a plurality of prestored programs for controlling the at least one light source, said at least one light fixture and said at least a second light fixture.

8. The portable, multifunction lighting apparatus of claim 2, wherein said controller receives control signals from an external device.

9. The portable, multifunction lighting apparatus of claim 8, wherein said external device is a digital data controller in accordance with a DMX protocol.

10. The portable, multifunction lighting apparatus of claim 2, wherein said at least one light fixture is a plurality of light fixtures, each of which can be placed on the light bar in a plurality of locations.

11. The portable, multifunction lighting apparatus of claim 2, wherein said controller is programmable using a control panel on a face of the light bar.

12. The portable, multifunction lighting apparatus of claim 2, wherein said controller is programmable from an external source.

13. The portable, multifunction lighting apparatus of claim 2, wherein said controller is programmable to operate in slave mode, receiving signals from another portable multifunction lighting apparatus operating in master mode.

14. A portable, multifunction lighting system, comprising:

two or more portable, multifunction lighting apparatuses according to claim 1;

exactly one of said two or more portable, multifunction lighting apparatuses configured to operate in master mode; and the remaining portable, multifunction lighting apparatuses configured to operate in a slave mode.

15. A portable, multifunction lighting system, comprising:

two or more portable, multifunction lighting apparatuses, including:

a mounting light bar having an internal cavity and at least one opening formed in an outer surface of the mounting light bar;

at least one light source mounted within the internal cavity in alignment with said at least one opening, wherein each of the at least one light sources emits light through said at least one opening;

at least one light fixture removably secured to the mounting light bar outside said internal cavity; and a power source mounted within the internal cavity providing power to said at least one light source and said at least one light fixture;

exactly one of said two or more portable, multifunction lighting apparatuses configured to operate in master mode, and the remaining portable, multifunction lighting apparatuses configured to operate in a slave mode;

said two or more portable, multifunction lighting apparatuses connected together in a daisy chain;

wherein each portable, multifunction lighting apparatus includes a control signal input interface and a control signal output interface and the control signal output interface of the master at least one of: is connected to the control signal input interface of a first slave using a cable; or wirelessly communicates control signals to the control signal interface of a first slave.

16. The portable, multifunction lighting system of claim 15, wherein the control signal output interface of the master is connected to the control signal input interface of a first slave using a cable.

17. The portable, multifunction lighting system of claim 15, wherein the control signal output interface of the master wirelessly communicates control signals to the control signal interface of a first slave.

18. A portable, multifunction lighting system kit, comprising:

a portable, multifunction lighting apparatus according to claim 3; and a bag configured to receive the light bar and stand, when detached from one another.

19. A method of using a portable, multifunction lighting system including multiple different lighting effects, comprising the steps of:

providing a first portable, multifunction lighting apparatus, including:

a mounting light bar extending longitudinally and having an internal cavity and at least one opening formed in an outer surface of a longitudinally extending face of the mounting light bar;

at least one light source providing a first lighting effect mounted within the internal cavity in alignment with said at least one opening through the longitudinally extending face, wherein each at least one light source emits light through said at least one opening in accordance with the first lighting effect;

at least one light fixture removably secured to the mounting light bar outside said internal cavity and providing a second lighting effect different from the first lighting effect;

at least a second light fixture removably secured to the mounting light bar outside said internal cavity and providing a third lighting effect different from the first and second lighting effects;

a power source mounted within the internal cavity providing power to at least one of said at least one light source, said at least one light fixture or said at least a second light fixture; and operating the portable, multifunction lighting system to illuminate at least one of said at least one light source, said at least one light fixture or said at least a second light fixture.

20. The method of claim 19, wherein said method further includes:

providing at least a second portable, multifunction lighting apparatus;

connecting the first portable, multifunction lighting apparatus to the at least a second portable, multifunction lighting apparatus;

configuring the first portable, multifunction lighting apparatus as a master device and the second portable, multifunction lighting apparatus as a slave device; and providing control signals from said first portable, multifunction lighting apparatus to said second portable, multifunction lighting apparatus to control the second portable, multifunction lighting apparatus from, and in unison with, the first portable, multifunction lighting apparatus.

* * * * *